US010808926B2

(12) United States Patent
Chen

(10) Patent No.: US 10,808,926 B2
(45) Date of Patent: Oct. 20, 2020

(54) FIRE DISPLAY DEVICE

(71) Applicant: Pro-Iroda Industries, Inc., Taichung (TW)

(72) Inventor: Wei-Long Chen, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 155 days.

(21) Appl. No.: 15/838,416

(22) Filed: Dec. 12, 2017

(65) Prior Publication Data

US 2019/0101281 A1 Apr. 4, 2019

(30) Foreign Application Priority Data

Oct. 2, 2017 (TW) ..... 106134042 A

(51) Int. Cl.

| | |
|---|---|
| ***F23D 3/18*** | (2006.01) |
| ***F23D 14/84*** | (2006.01) |
| ***F23Q 9/08*** | (2006.01) |
| ***F24C 5/04*** | (2006.01) |
| ***F23D 3/24*** | (2006.01) |

(52) U.S. Cl.

CPC ..... *F23D 3/18* (2013.01); *F23D 3/24* (2013.01); *F23D 14/84* (2013.01); *F23Q 9/08* (2013.01); *F24C 5/04* (2013.01); *F23D 2900/00018* (2013.01); *F23D 2900/03082* (2013.01)

(58) Field of Classification Search

CPC ... F23D 14/84; F23D 3/18; F23D 3/24; F23D 2900/00018; F23D 2900/03082; F23Q 9/08; F24C 5/04

See application file for complete search history.

(56) References Cited

U.S. PATENT DOCUMENTS 2,324,753 A * 7/1943 Alexiade ..... C11C 5/006 431/291
2,462,440 A * 2/1949 Tierney ..... F21V 35/00 431/292
2,758,460 A * 8/1956 Ciano ..... F23D 3/00 431/206
3,910,753 A * 10/1975 Lee ..... F21S 13/12 431/290

(Continued)

FOREIGN PATENT DOCUMENTS

CN 103868062 A 6/2014
CN 104342290 A 2/2015

(Continued)

*Primary Examiner* — Avinash A Savani
*Assistant Examiner* — Martha M Becton
(74) *Attorney, Agent, or Firm* — Alan D. Kamrath; Karin L. Williams; Mayer & Williams PC

(57) ABSTRACT

A fire display device includes a fuel reservoir, a cap, a wick, and a fixture assembly for holding the wick. The cap is positioned within the fuel reservoir and forms a recess. The cap has at least one fuel injection hole and a first positioning hole both extending therethrough and in communication with the chamber and the recess. The wick is inserted through the first positioning hole and has a top end positioned above the cap and a bottom end positioned below the cap. The fixture assembly includes a clamping member with first and second clamping surfaces. The wick is clamped between the first and second clamping surfaces. The first and second clamping surfaces are inserted through the first positioning hole.

18 Claims, 5 Drawing Sheets

(56) References Cited

U.S. PATENT DOCUMENTS

| | | | | |
|---|---|---|---|---|
| 5,529,485 | A * | 6/1996 | D'Ambro | F23D 3/18 431/298 |
| 5,584,283 | A * | 12/1996 | Messina | A47J 36/24 126/43 |
| 5,797,739 | A * | 8/1998 | Lioi | F23D 3/02 126/45 |
| 6,033,209 | A * | 3/2000 | Shin | C11C 5/008 431/253 |
| 7,287,979 | B2 * | 10/2007 | Backes | F23D 5/04 431/338 |
| 9,476,586 | B2 * | 10/2016 | Chen | F23D 3/24 |
| 9,651,246 | B2 | 5/2017 | Chen | |
| 9,951,953 | B2 | 4/2018 | Hansen | |
| 2007/0111149 | A1 | 5/2007 | Matsuyama | |
| 2009/0220904 | A1 | 9/2009 | Masterson et al. | |
| 2014/0087318 | A1 * | 3/2014 | Chen | F23D 3/18 431/320 |
| 2014/0248572 | A1 * | 9/2014 | Chen | F23D 3/18 431/320 |
| 2015/0030988 | A1 * | 1/2015 | Chen | F23D 3/24 431/315 |
| 2015/0064635 | A1 * | 3/2015 | Chen | F23D 3/08 431/325 |
| 2015/0102116 | A1 * | 4/2015 | Pfister | B60H 1/2203 237/12.3 C |
| 2016/0061456 | A1 | 3/2016 | Jang | |
| 2018/0266677 | A1 * | 9/2018 | Chen | F23D 3/08 |
| 2019/0078791 | A1 | 3/2019 | Chen | |

FOREIGN PATENT DOCUMENTS

| | | | |
|---|---|---|---|
| CN | 104807005 | A | 7/2015 |
| CN | 109237469 | A | 1/2019 |
| TW | I506234 | B | 11/2015 |
| WO | WO2005077426 | A1 | 8/2005 |

* cited by examiner

FIRE DISPLAY DEVICE

BACKGROUND OF THE INVENTION

1. Field of the Invention

The present invention relates to a fire display device and, particularly, to a fire display device that burns liquid fuel.

2. Description of the Related Art

Generally, there are two types of fuel burning devices of which one type that produces a flame by igniting an easy flammable fuel directly and one type that has a wick and produces a flame burning from a wick.

A bio fuel fireplace commonly uses an easy flammable bio fuel and has a fuel reservoir defining a chamber for holding the bio fuel and an opening for permits the bio fuel to be poured into the fuel reservoir. It is commonly seen that the fuel reservoir is made of stainless steel.

It is difficult to provide a constant flame if the bio fuel is ignited directly. In addition, the flame will transfer heat to the fuel reservoir, and it is dangerous to touch the fuel reservoir. Thus, for safety reasons, the fuel reservoir is refilled after it cools and when the flame is completely extinguished. If the flame is not completely extinguished, it may result in a flash over.

Some bio fuel fireplaces are not used by igniting bio fuel directly and use ceramic fibers. The ceramic fibers can control the flame, but does not prevent the flame transferring heat to the fuel reservoir. Therefore, if it the fuel reservoir is not cooled or if the flame is not completely extinguished, it is dangerous to refill the fuel reservoir.

TW Pat. No. I506234 shows a fuel burning device with a safety cover. The fuel burning device includes a fuel reservoir and a mounting seat that can hold a wick and is designed to have the effect of preventing the fuel reservoir from getting hot. When refilling the fuel reservoir, fuel is poured on the mounting seat and then flows through holes of the mounting seat into a chamber of the fuel reservoir. However, it is still desirable that the fuel burning device can allow a user to refill the fuel reservoir conveniently and to notice if the fuel reservoir is overfilled.

The present invention is, therefore, intended to obviate or at least alleviate the problems encountered in the prior art.

SUMMARY OF THE INVENTION

According to the present invention, a fire display device includes a fuel reservoir. A cap is positioned within a chamber defined in the fuel reservoir. The cap forms a recess. The cap has at least one fuel injection hole and a first positioning hole both extending therethrough and in communication with the chamber and the recess. A wick is inserted through the first positioning hole and has a top end positioned above the cap and a bottom end positioned below the cap. A fixture assembly includes a clamping member with first and second clamping surfaces. The wick is clamped between the first and second clamping surfaces. The first and second clamping surfaces are inserted through the first positioning hole.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
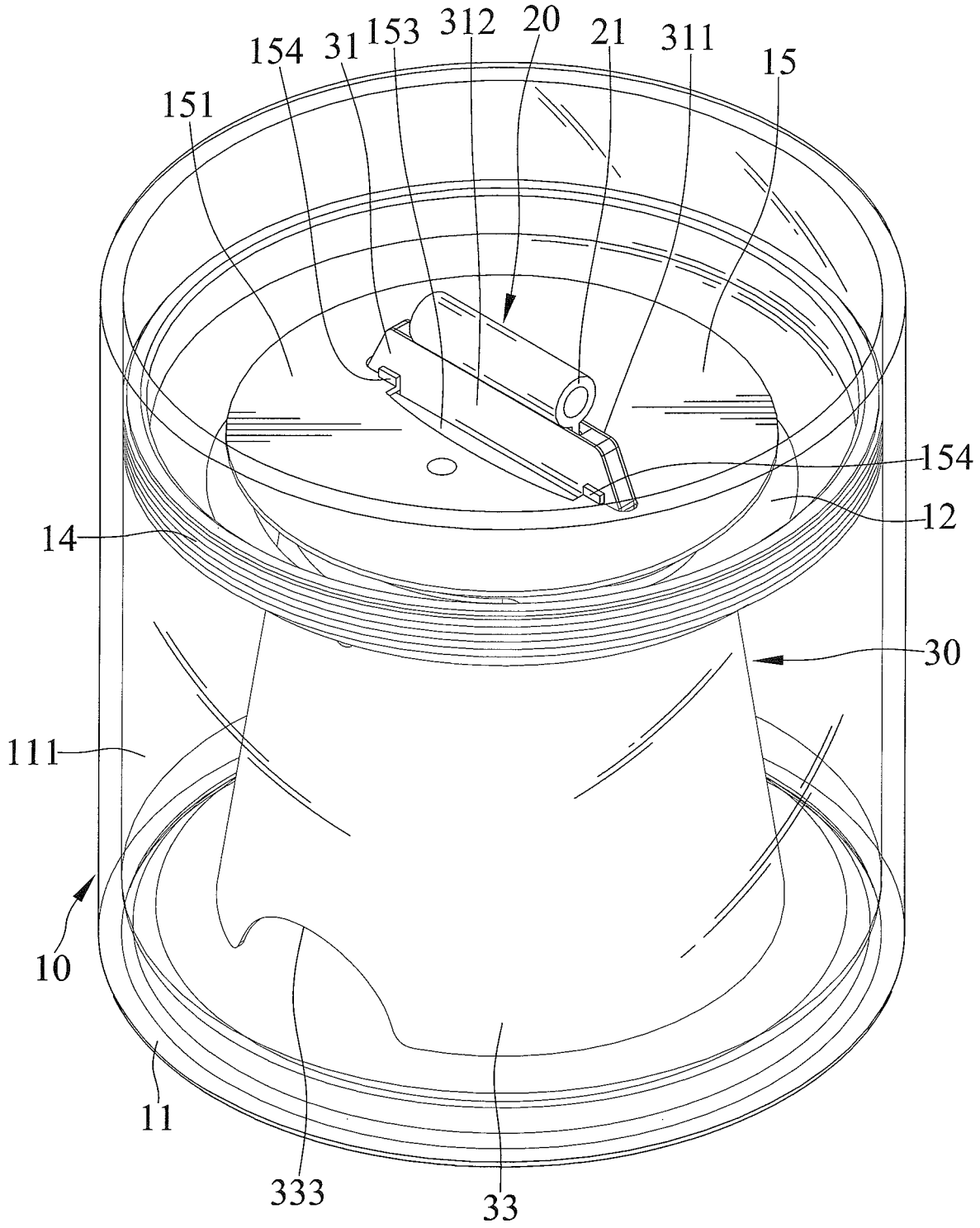
FIG. 1 is a perspective view of a fire display device in accordance with the present invention.
Figure 2:
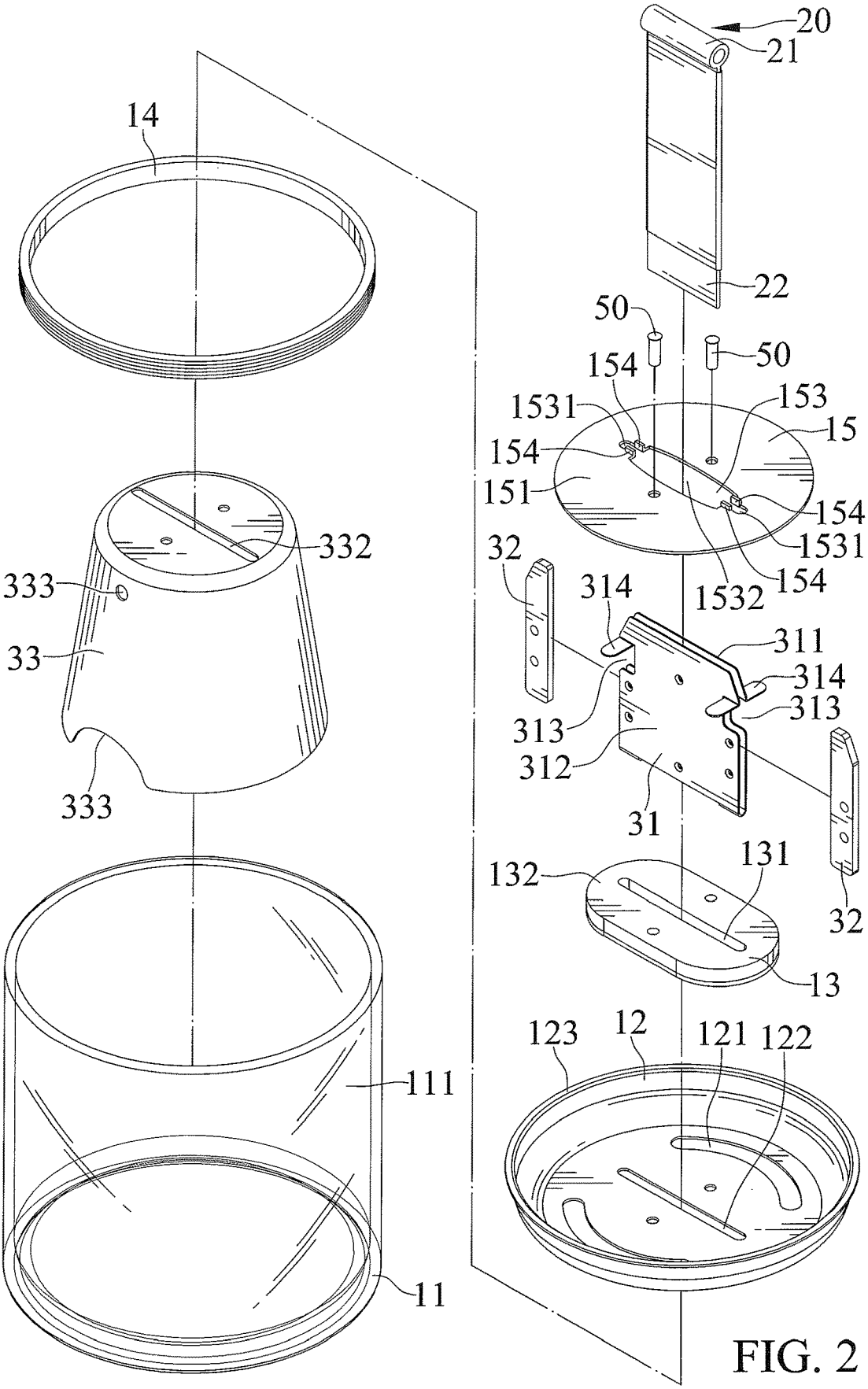
FIG. 2 is an exploded perspective view of the fire display device of FIG. 1.
Figure 3:
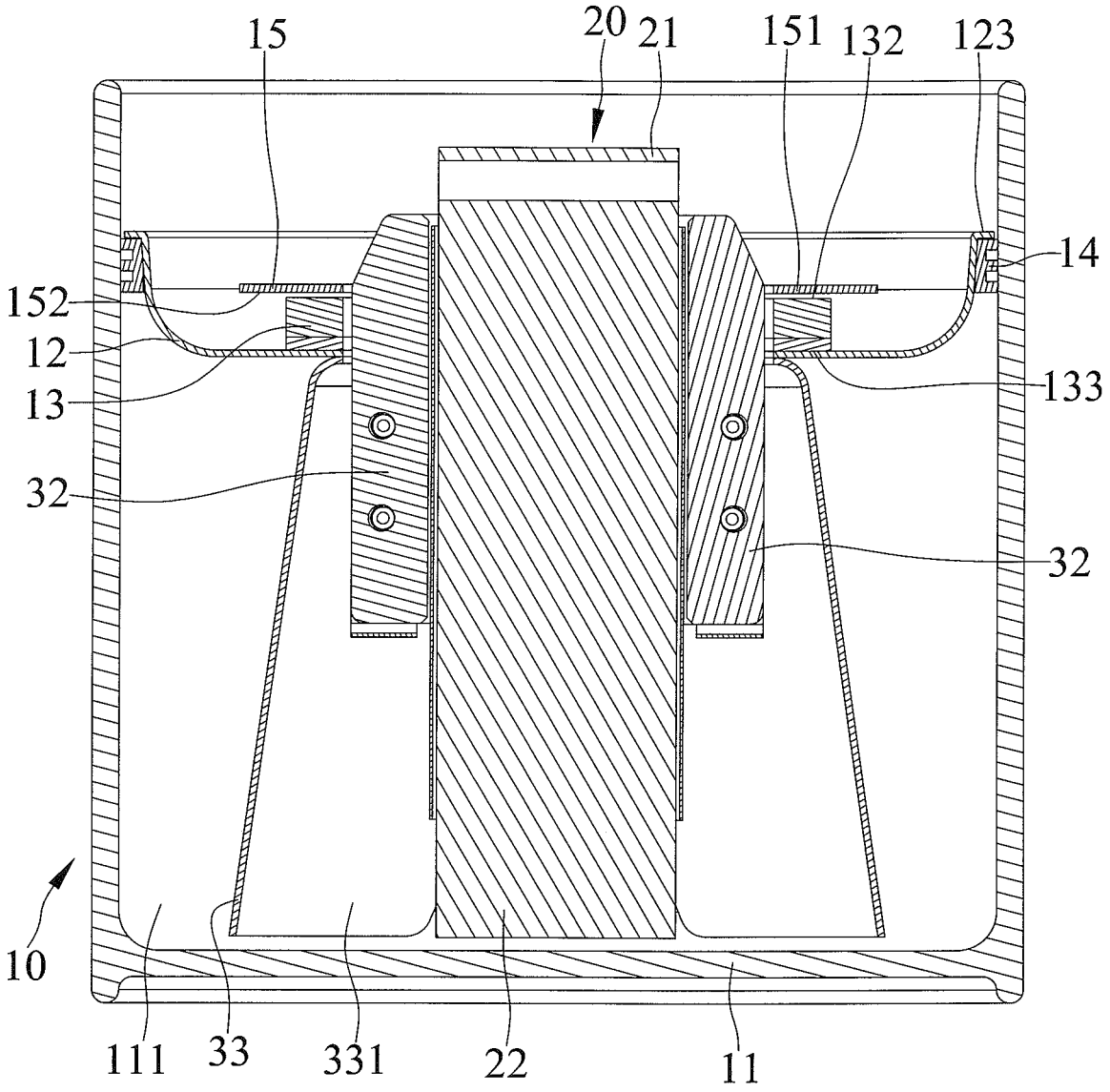
FIG. 3 is a cross-sectional view of the fire display device of FIG. 1.

FIGS. 1 through 5 show a fire display device 10 in accordance with the present invention. The fire display device 10 includes a fuel reservoir 11. The fuel reservoir 11 is made of a material visible therethrough.

A cap 12 is positioned within a chamber 111 defined in the fuel reservoir 11. The cap 12 forms a recess. The cap 12 has at least one fuel injection hole 121 and a first positioning hole 122 both extending therethrough and in communication with the chamber 111 and the recess. In the embodiment, there are two fuel injection holes 121. Each fuel injection hole 121 is crescent-shaped.

A thermal insulating member 13 is positioned within the recess of the cap 12. The thermal insulating member 13 has a second positioning hole 131 extending therethrough.

A seal 14 is positioned between an outer periphery of the cap 12 and an inner periphery of the reservoir 11. The seal 14 is also retained by a rim 123 of the cap 12. The seal 14 seals a gap between the fuel reservoir 11 and the cap 12. The seal 14 is made of rubber. The seal 14 is ring-shaped.

A cover 15 partially covers the recess of the cap 12 and is connected to the cap 12. The cover 15 has a width smaller than a width of the recess of the cap 12. The cover 15 is positioned above the thermal insulating member 13. The cover 15 has a third positioning hole 153 extending therethrough and the first and second clamping surfaces 311 and 312 are inserted through the third positioning hole 153. The cover 15 has a top side 151 and a bottom side 152 opposite the top side 151. The third positioning hole 153 extends through the top and bottom sides 151 and 152. The third positioning hole 153 has two end sections 1531 and a middle section 1532 positioned between and connected to the two end sections 1531.

A wick 20 is inserted through the first and second positioning holes 122 and 131. The wick 20 has a top end 21 positioned above the cap 12 and a bottom end 22 positioned below the cap 12. The wick 20 is also inserted through the middle section 1532 of the cover. The top end 21 of the wick 20 is positioned above the cover 15. The cover 15 has at least two retainers 154 protruding therefrom and positioned on opposite sides of the third positioning hole 153. The wick 20 is made of metal and does not burn out. The top end 21 of the wick 20 has a substantially circular outer periphery. The bottom end 22 of the wick 20 has an outer periphery including two substantially parallel sides.

A fixture assembly 30 holds the wick 20. The fixture assembly 30 includes a clamping member 31 with first and second clamping surfaces 311 and 312. The wick 20 is clamped between the first and second clamping surfaces 311 and 312. The first and second clamping surfaces 311 and 312 are inserted through the first and second positioning holes 122 and 131. The first and second clamping surfaces 311 and 312 are positioned between the at least two retainers 154, with one retainer 154 abutting an outer side of the first clamping surface 311, and with another retainer 154 abutting an outer side of the second clamping surface 312. The at least two retainers 154 are positioned on opposite sides of one of the two end sections 1531.

The clamping member 31 includes two restrainers 32 abutting the first and second clamping surfaces 311 and 312 and the wick 20 is positioned between and restrained by the two restrainers 32. The restrainer 32 is fixed between the first and second clamping surfaces 311 and 312 in that the restrainer 32 has cavities correspond to protuberances of the first and second clamping surfaces 311 and 312.

The first clamping surface 311 has at least one first notch 313 formed in an edge thereof. The second clamping surface 312 has at least one second notch 313 formed in an edge thereof and adjacent the at least one first notch 313. One of the restrainers 32 has a first side partially exposed through the at least one first notch 313 and a second side opposite the first side partially exposed through the at least one second notch 313. The at least one first and second notches 313 can facilitate insertion and positioning of the restrainer 32. In the embodiment, there are two first notches 313 and two second notches 313. Thus, one restrainer 32 corresponds to one first notch 313 and one second notch 313 and another restrainer 32 corresponds to another first notch 313 and another second notch 313, respectively.

The clamping member 31 has a first support member 314 contiguous to the first clamping surface 311 and a second support member 314 contiguous to the second clamping surface 312. The thermal insulating member 13 has a surface bearing the first and second support members 314. The first and second support members 314 extend in opposite directions. The thermal insulating member 13 has a top surface 132 bearing the first and second support members 314 and a bottom surface 133 opposite the top surface 132.

A hollow base 33 is positioned within the chamber 111. The base 33 is connected to the cap 12. The base 33 is positioned below the cap 12. The base 33 has a platform and a fourth positioning hole 332 extending through the platform. The wick 20 is inserted through the fourth positioning hole 332 and the bottom end 22 of the wick 20 is positioned within a hollow compartment 331 defined in the base 33. The first and second clamping surfaces 311 and 312 are inserted through the fourth positioning hole 332. Further, the base 33 has a side extending circumferentially and at least one orifice 333 extending through the side. Thus, the compartment 331 is in fluid communication with the chamber 111.

Figure 4:
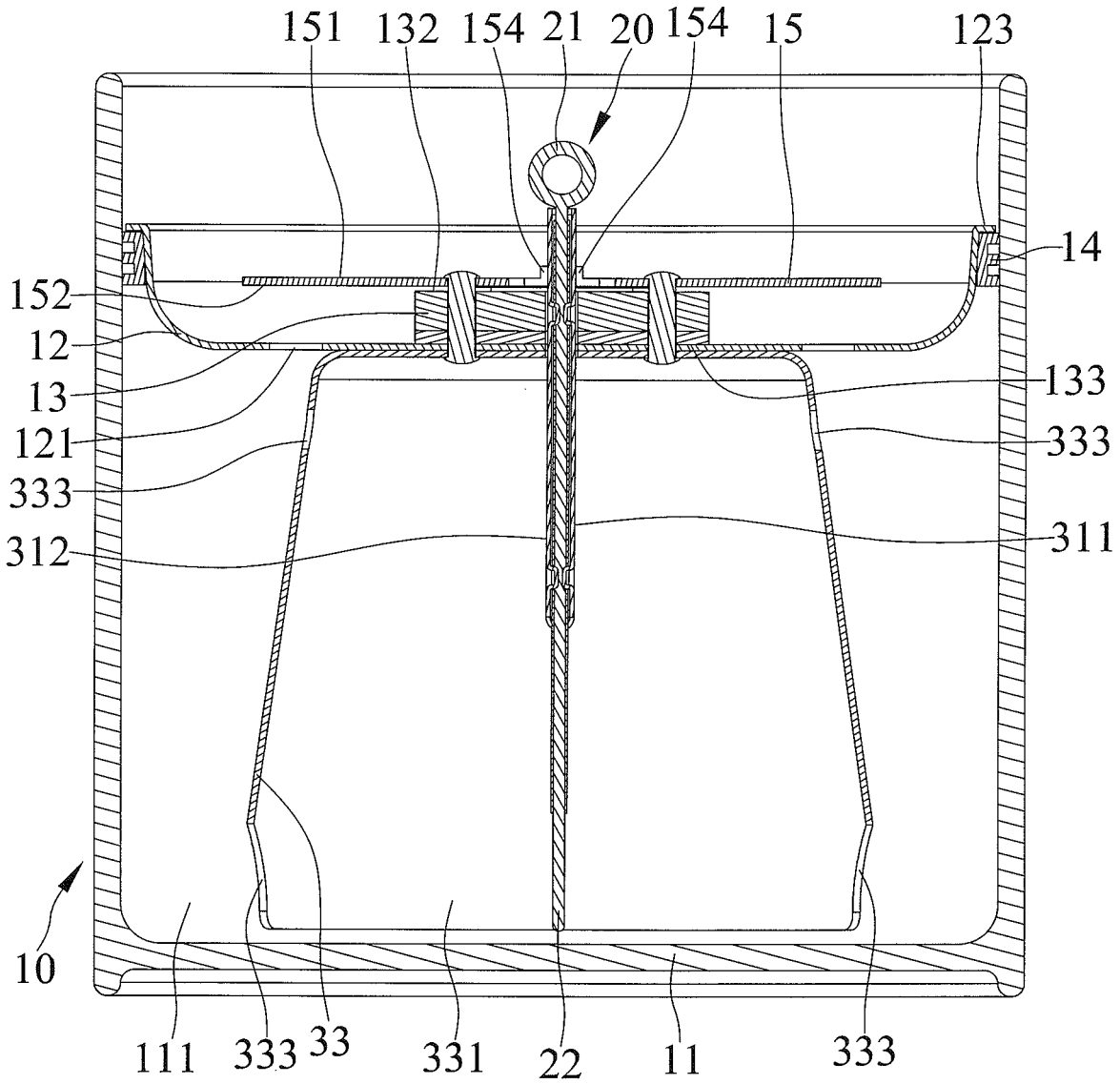
FIG. 4 is another cross-sectional view of the fire display device of FIG. 1.

The cover 15, the thermal insulating member 13, the cap 12, and the base 33 are connected together by at least one fastener 50, as shown in FIG. 4. The cover 15, the insulating member 13, the cap 12 and the base 33 have fastener holes in which the at least one fastener 50 engages.

Figure 5:
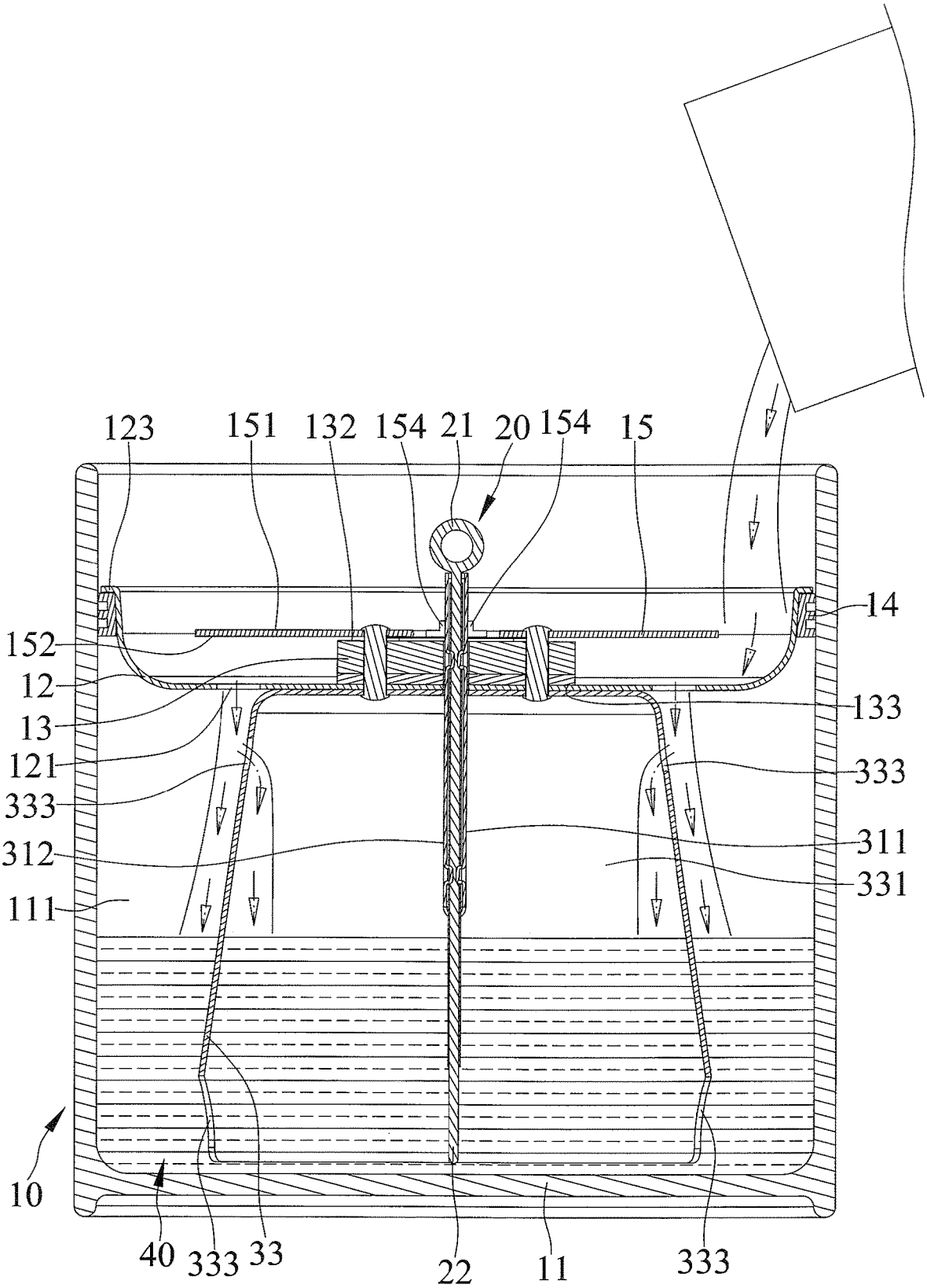
FIG. 5 is a cross-sectional view illustrating fuel is poured into the fire display device of FIG. 1

In addition, FIG. 5 illustrates filling the fuel reservoir 11 with liquid fuel 40. The fuel reservoir 11 is filled by pouring the liquid fuel 40 onto the cap 12 through an open end of the fuel reservoir 11 and a gap between the cap 12 and the cover 15. Then, the liquid fuel 40 will flow though the two fuel injection holes 121 into the chamber 111.

In view of the forgoing, a user can see how much liquid fuel 40 is poured into the recess of the cap 12 and how much is left in the fuel reservoir 11. Furthermore, the fire display device 10 has a simple design and it is easy to manufacture and assemble its components together. Moreover, the chamber 111 of the fuel reservoir 11 receives the cap 12, the thermal insulating member 13, the wick 20, and the fixture assembly 30 to provide an enhanced aesthetic effect.

The foregoing is merely illustrative of the principles of this invention, and various modifications can be made by those skilled in the art without departing from the scope and spirit of the invention.

What is claimed is:

1. A fire display device comprising:

a fuel reservoir;

a cap positioned within the fuel reservoir, wherein the cap forms a recess, wherein the cap has at least one fuel injection hole and a first positioning hole both extending there through and in communication with the recess, and wherein the at least one fuel injection hole and the first positioning hole extend through the recess;

a wick inserted through the first positioning hole and having a top end positioned above the cap and a bottom end positioned below the cap;

a fixture assembly holding the wick, wherein the fixture assembly includes a clamping member with first and second clamping surfaces, wherein the wick is clamped between the first and second clamping surfaces, and wherein the first and second clamping surfaces are inserted through the first positioning hole;

a cover connected to the cap and partially covering the recess of the cap so as to form an annular gap between an outer circumference of the cover and the recess, wherein the cover has a third positioning hole extending therethrough in which the first and second clamping surfaces and the wick are inserted through, and wherein the top end of the wick is positioned above the cover; and a thermal insulating member positioned within the recess of the cap, wherein the thermal insulating member has a second positioning hole extending therethrough, and wherein the first and second clamping surfaces are also inserted through the second positioning hole, wherein the thermal insulating member has a surface bearing a first and second support members of the clamping member, and wherein the first support member is contiguous to the first clamping surface and the second support member is contiguous to the second clamping surface respectively.

2. The fire display device as claimed in claim 1, wherein the cover is positioned above the thermal insulating member.

3. The fire display device as claimed in claim 2 further comprising a seal positioned between the cap and an inner periphery of the fuel reservoir.

4. The fire display device as claimed in claim 2, wherein the clamping member includes two restrainers abutting and fixed between the first and second clamping surfaces, and wherein the wick is positioned between and restrained by the two restrainers.

5. The fire display device as claimed in claim 2 further comprising a hollow base positioned within the chamber, wherein the base is positioned below the cap and disposed within the chamber, wherein the base has a platform and a fourth positioning hole extending through the platform, wherein the wick is inserted through the fourth positioning hole and the bottom end of the wick is positioned within a hollow compartment defined in the base, and wherein the first and second clamping surfaces are inserted through the fourth positioning hole.

6. The fire display device as claimed in claim 5, wherein the base has a side extending circumferentially and at least one orifice extending through the side.

7. The fire display device as claimed in claim 5 further comprising a seal positioned between the cap and an inner periphery of the fuel reservoir.

8. The fire display device as claimed in claim 7, wherein the fuel reservoir is visible therethrough.

9. The fire display device as claimed in claim 8, wherein the wick is made of metal.

10. The fire display device as claimed in claim 9, wherein the top end of the wick has a substantially circular outer periphery, and wherein the bottom end of the wick has an outer periphery including two substantially parallel sides.

11. The fire display device as claimed in claim 2, wherein the cover has at least two retainers protruding therefrom and positioned on opposite sides of the third positioning hole, and wherein the first and second clamping surfaces are positioned between the at least two retainers, with one retainer abutting an outer side of the first clamping surface, and with another retainer abutting an outer side of the second clamping surface.

12. The fire display device as claimed in claim 11, wherein the third positioning hole has two end sections and the at least two retainers are positioned on opposite sides of one of the two end sections, and wherein the third positioning hole has a middle section positioned between and connected to the two end sections and the wick is inserted through the middle section.

13. The fire display device as claimed in claim 1, wherein the clamping member includes two restrainers abutting and fixed between the first and second clamping surfaces, and wherein the wick is positioned between and restrained by the two restrainers.

14. The fire display device as claimed in claim 13, wherein the first clamping surface has at least one first notch and the second clamping surface has at least one second notch respectively, wherein the at least one second notch is adjacent the at least one first notch, and wherein one of the restrainers has a first side partially exposed through the at least one first notch and a second side opposite the first side partially exposed through the at least one second notch.

15. The fire display device as claimed in claim 1 further comprising a seal positioned between the cap and an inner periphery of the fuel reservoir.

16. The fire display device as claimed in claim 1, wherein the fuel reservoir is visible therethrough.

17. The fire display device as claimed in claim 1, wherein the wick is made of metal.

18. The fire display device as claimed in claim 17, wherein the top end of the wick has a substantially circular outer periphery, and wherein the bottom end of the wick has an outer periphery including two substantially parallel sides.

* * * * *